US006746497B1

(12) United States Patent
Kaneko

(10) Patent No.: US 6,746,497 B1
(45) Date of Patent: Jun. 8, 2004

(54) WASTE INCINERATION DISPOSAL METHOD

(75) Inventor: Masamoto Kaneko, Takasaki (JP)

(73) Assignee: Kinsei Sangyo Co., Ltd., Gumma (JP)

( * ) Notice: Subject to any disclaimer, the term of this patent is extended or adjusted under 35 U.S.C. 154(b) by 0 days.

(21) Appl. No.: 09/784,448

(22) PCT Filed: Aug. 19, 1999

(86) PCT No.: PCT/JP99/04449

§ 371 (c)(1),
(2), (4) Date: Feb. 27, 2001

(87) PCT Pub. No.: WO00/12938

PCT Pub. Date: Mar. 9, 2000

(30) Foreign Application Priority Data

Aug. 27, 1998 (JP) ..... 10-241194

(51) Int. Cl.[7] ..... C10J 3/00

(52) U.S. Cl. ..... 48/197 FM; 48/77; 48/89; 48/101; 48/111; 48/119; 48/123; 48/209; 48/210; 201/1; 201/15; 201/25; 201/27; 201/29; 201/37; 422/165; 422/184.1; 422/188; 422/189; 422/232; 422/234; 422/235; 422/105; 422/107; 422/108; 422/109; 422/110; 422/111; 422/116

(58) Field of Search ..... 201/1, 15, 25, 201/27, 28, 29, 36, 37; 202/84, 85, 208, 209; 48/61, 62 R, 77, 89, 101, 111, 119, 123, 209, 210, 197 FM; 422/164, 165, 184.1, 188, 189, 232, 234, 235, 105, 107, 108, 109, 110, 111, 116

(56) References Cited

U.S. PATENT DOCUMENTS

| | | |
|---|---|---|
| 4,516,510 A | 5/1985 | Basic, Sr. |
| 5,397,551 A | 3/1995 | Won Sam |

FOREIGN PATENT DOCUMENTS

| | | |
|---|---|---|
| DE | 39 41 636 | 6/1990 |
| EP | 0 287 534 | 10/1988 |
| EP | 0 300 396 | 1/1989 |
| EP | 0 543 480 | 5/1993 |

*Primary Examiner*—Jerry D. Johnson
*Assistant Examiner*—Basia Ridley
(74) *Attorney, Agent, or Firm*—Paul A. Guss

(57) ABSTRACT

A waste is dry-distilled in a gasification furnace and generated combustible gas is combusted in a combustion furnace. A temperature in the combustion furnace is set to be substantially constant at a first preset temperature or more. When the temperature in the combustion furnace is greater than the first preset temperature by combustion of other fuels, the combustible gas is introduced. When the temperature in the combustion furnace reaches a second preset temperature or more by the combustion of only the combustible gas, the combustion of the other fuels is finished. When the temperature in the combustion furnace falls below a third preset temperature the combustion of the other fuels is resumed. When the temperature in the gasification furnace falls below a fourth preset temperature, the combustion of the other fuels is finished.

9 Claims, 3 Drawing Sheets

PRIOR ART

WASTE INCINERATION DISPOSAL METHOD

TECHNICAL FIELD

The present invention relates to a waste incineration disposal method.

BACKGROUND ART

In recent years, it has been pointed out that dioxins are generated during incineration disposal of a waste. In many cases, the waste contains chlorine. Therefore, when the waste is combusted at a temperature of 250 to 350° C., chlorine liberated from the waste, and hydrocarbon generated by incomplete combustion of resins react with each other using a catalyst of a heavy metal contained in the waste, and dioxins are generated.

In order to prevent dioxins emission by the incineration disposal of the waste, it is said to be effective to retain the waste at 800° C. or more for two seconds or more, and completely thermally decompose the generated dioxins. However, even when the wastes such as miscellaneous living wastes, paper, and soft vinyl chloride are incinerated, it is difficult to stably keep the wastes at 800° C. or a higher temperature. Therefore, in order to prevent the dioxins emission, in general, the wastes are combusted together with other fuels such as a heavy oil, and thereby stably incinerated at 800° C. or more. In this case, since the other fuels have to be combusted together with the wastes through the entire incineration disposal process, a large amount of other fuels are required, and a running cost increase cannot be avoided.

Additionally, the present applicant has proposed an apparatus disclosed in Japanese Patent Application Laid-Open No. 135280/1990 as an incineration disposal apparatus of wastes such as a waste tire.

The apparatus disclosed in the above publication is constituted of a fully closed gasification furnace, and a combustion furnace connected to the gasification furnace via a gas passage a part of the waste is combusted in the gasification furnace, and a combustible gas generated by dry distillation of the other part of the waste with the combustion heat is introduced into the combustion furnace to completely combusted the waste. Details of incineration disposal of the waste by the apparatus will next be described.

During the incineration disposal of the waste by the apparatus, first the waste contained beforehand in the fully closed gasification furnace is ignited, a part of the waste is combusted, and the other part thereof is dry-distilled by the combustion heat. Moreover, the combustible gas generated by the dry distillation is introduced into the combustion furnace disposed outside the gasification furnace via the gas passage.

Subsequently, a combustion flame is supplied to the introduced combustible gas to ignite the gas, thereby starting combustion of the combustible gas.

Next, when the dry distillation progresses and the combustible gas is stably generated, an amount of generated combustible gas gradually increases, and a combustion temperature of the combustible gas detected as a temperature $T_2$ in the combustion furnace gradually rises as shown in FIG. 3. In this case, the temperature $T_2$ in the combustion furnace reaches a temperature $T_{2a}$ at which the combustible gas can spontaneously and stably continue the combustion by its own combustion heat, and the supply of the combustion flame is then stopped.

Subsequently, oxygen necessary for complete combustion of the combustible gas is supplied to the combustion furnace in accordance with the amount of the combustible gas introduced into the combustion furnace. Additionally, while the combustible gas is completely combusted, the temperature $T_2$ in the combustion furnace is detected as the combustion temperature of the combustible gas, an amount of oxygen supplied to the gasification furnace is controlled in accordance with a change of temperature $T_2$, and the amount of the combustible gas generated by the dry distillation is adjusted. In the apparatus, the temperature $T_2$ in the combustion furnace can be maintained in this manner to be substantially constant at a temperature $T_{2b}$ higher than a temperature $T_{2a}$ at which the combustible gas spontaneously and stably continues the combustion.

In the apparatus, when the dry distillation further progresses, a portion of the waste able to be dry-distilled in the gasification furnace is reduced. Even when the amount of oxygen supplied to the gasification furnace is increased, a sufficient amount of combustible gas for maintaining the temperature $T_2$ in the combustion furnace to be substantially constant at the temperature $T_{2b}$ cannot be generated Then, the temperature $T_2$ in the combustion furnace gradually drops, the dry distillation and combustion of the waste in the gasification furnace are finished and the waste is ashed. Additionally, a temperature in the gasification furnace is shown as $T_1$ in FIG. 3.

As a result, according to the apparatus, the dry distillation of the waste and the complete combustion of the combustible gas can stably be performed, and in a stage in which the combustible gas spontaneously and stably, continues the combustion, the temperature in the combustion furnace can be maintained to be substantially constant at a preset or higher temperature.

Here, when the apparatus disclosed in the above publication is used in the incineration disposal of the waste, the waste is regulated so as to generate the combustible gas having heat amount for setting a combustion temperature at which dioxins can thermally be decomposed, for example, at 800° C. or more. Then, in the stage in which the combustible gas spontaneously and stably continues the combustion, the temperature in the combustion furnace can be maintained to be substantially constant at 800° C. or more. Therefore, to keep the temperature in the combustion furnace at 800° C. or more, it is unnecessary to combusted other fuels such as a heavy oil, and the dioxins emission can be prevented at a low cost.

However, during the aforementioned waste incineration disposal, in the stage in which the combustible gas spontaneously and stably continues the combustion after the start of the waste dry distillation, and in the stage in which the portion of the waste able to be dry-distilled in the gasification furnace is reduced and the waste is ashed after the stage of the spontaneous and stable continuation of the combustion of the combustible gas, the temperature in the combustion furnace does not reach 800° C. and there is a disadvantage that dioxins are emitted.

DISCLOSURE OF THE INVENTION

To solve the aforementioned disadvantage, an object of the present invention is to provide a waste incineration disposal method which can prevent dioxins emission and reduce running costs.

To achieve the aforementioned object, the waste incineration disposal method of the present invention comprises steps of: combusting a part of a waste contained in a gasification furnace, and dry-distilling the other part of the waste by a combustion heat; and introducing a combustible gas generated by the dry distillation into a combustion furnace to combusted the combustible gas. When the combustible gas is combusted in the combustion furnace, oxygen required for the combustion is supplied to the combustion furnace in accordance with an amount of the combustible gas introduced into the combustion furnace to combusted the combustible gas, an amount of oxygen supplied to the gasification furnace is controlled in accordance with a temperature change in the combustion furnace by the combustion of the combustible gas in the combustion furnace, the amount of the combustible gas generated by the dry distillation is adjusted, and the temperature in the combustion furnace is maintained to be substantially constant at a first preset temperature or more. In the waste incineration method, the waste regulated to generate the combustible gas having a heat amount for setting the temperature in the combustion furnace at the first preset temperature or more during the combustion is contained in the gasification furnace. Fuels other than the combustible gas are combusted in the combustion furnace prior to ignition of the waste. When the temperature in the combustion furnace reaches the first preset temperature or more, the waste is ignited to start dry distillation, and the generated combustible gas is combusted with the other fuels. When the temperature in the combustion furnace reaches a second preset temperature higher than the first preset temperature or more by the combustion of only the combustible gas, the combustion of the other fuels is finished, the temperature in the combustion furnace is maintained to be substantially constant at the second preset temperature or more, and only the combustible gas is combusted. When the temperature in the combustion furnace falls below a third preset temperature lower than the substantially constant temperature and higher than the first preset temperature, the combustion of the other fuels is resumed, the combustible gas is combusted with the other fuels, and the temperature in the combustion furnace is maintained at the first preset temperature or more. When the temperature in the gasification furnace falls below a fourth preset temperature lower than a maximum temperature in the gasification furnace, the combustion of the other fuels is finished.

In the method of the present invention, the apparatus disclosed in the aforementioned publication is used, the waste regulated to generate the combustible gas having the heat amount for setting the temperature in the combustion furnace at the first preset temperature or more during combustion is contained in the gasification furnace, and the waste incineration disposal is performed. Here, the first preset temperature is a temperature at which dioxins can thermally be decomposed, and is concretely set at 800° C. or more.

In this constitution, when the combustible gas generated by the dry distillation of the waste in the gasification furnace is combusted in the combustion furnace, in the stage in which the combustible gas spontaneously and stably continues the combustion, the other fuels such as a heavy oil are not combusted, the temperature in the combustion furnace is maintained to be substantially constant at 800° C. or more by the heat amount of the combustible gas itself and the dioxins emission can be prevented.

Moreover, in the method of the present invention, prior to ignition of the waste, the fuels other than the combustible gas are combusted in the combustion furnace, and the combustion furnace interior is heated at the first preset temperature or more before the combustible gas is introduced into the combustion furnace. Furthermore, when the temperature in the combustion furnace reaches the first preset temperature or more, the waste in the gasification furnace is ignited thereby starting the dry distillation of the waste. As a result, while the temperature in the combustion furnace is not less than the first preset temperature, the combustible gas generated by the dry distillation is introduced into the combustion furnace, and the dioxins emission in the initial stage of dry distillation can be prevented.

In the initial stage of the dry distillation, since the dry distillation is not sufficiently stabilized, the amount of the generated combustible gas is not stable, and it is difficult to maintain the first preset or higher temperature in the combustion furnace by the combustion of only the combustible gas. To solve this problem, in the method of the present invention, the combustible gas is combusted with the other fuels in the initial stage of the dry distillation, and the first preset or higher temperature is thereby maintained in the combustion furnace. Moreover, when the temperature in the combustion furnace reaches the second preset temperature higher than the first preset temperature, or more by the combustion of only the combustible gas, it is judged that the combustible gas can spontaneously and stably continue the combustion, and the combustion of the other fuels is finished. As a result, from the start of the dry distillation until the combustible gas can spontaneously and stably continue the combustion, the dioxins emission can be prevented.

After the combustion of the other fuels is finished, the temperature in the combustion furnace is maintained to be not less than the second preset temperature, that is, to be substantially constant at the first preset temperature or more, and only the combustible gas is combusted. Therefore, as described above, the dioxins emission can be prevented in this stage.

When the waste dry distillation progresses in the gasification furnace and the portion able to be dry-distilled is reduced, the amount of generated combustible gas decreases, and the temperature in the combustion furnace starts dropping from the temperature which is substantially constant at the second preset temperature or more. However, in this stage, the temperature in the gasification furnace is high, and there is still a possibility that dioxins are generated.

To solve the problem, in the method of the present invention, next, when the temperature in the combustion furnace starts dropping from the substantially constant temperature being not less than the second preset temperature, the combustion of the other fuels is resumed at a point at which the temperature falls below the third preset temperature higher than the first preset temperature, so that the temperature in the combustion furnace is not lower than the first preset temperature. When the combustible gas is combusted with the other fuels, the portion of the waste able to be dry-distilled in the gasification furnace is reduced. Even when the amount of the generated combustible gas is reduced, the temperature in the combustion furnace is maintained at or above the first preset temperature.

Moreover, when the temperature in the gasification furnace falls below the fourth preset temperature lower than the maximum temperature in the gasification furnace, it is Judged that the dioxins are not contained in the combustible gas, and the combustion of the other fuels is finished. Here, the fourth preset temperature is concretely set to be less than a dioxins generation temperature. As a result, the dioxins emission can be prevented in the stage in which the portion of the waste able to be dry-distilled in the gasification furnace is reduced and the waste is ashed.

When the combustion of the other fuels is finished, the portion of the waste able to be dry-distilled in the gasification furnace is finally eliminated, the waste is ashed, and extinction naturally occurs. Moreover, even in the combustion furnace, with the decrease of the portion of the waste able to be dry-distilled in the gasification furnace, the amount of the combustible gas is reduced, the spontaneous combustion cannot be maintained, and extinction naturally occurs. As a result, the incineration disposal according to the method of the present invention is naturally finished.

As described above, according to the method of the present invention, from the start of the waste dry distillation until the temperature in the gasification furnace falls below the dioxins generation temperature, the temperature in the combustion furnace is maintained at the first preset temperature or more. Therefore, the dioxins emission can securely be prevented over the entire waste incineration process.

Moreover, in the method of the present invention, in the stage after the waste dry distillation is started and before the combustible gas spontaneously and stably continues the combustion, and in the stage in which the portion of the waste able to be dry-distilled in the gasification furnace is reduced and the waste is ashed after the stage of the spontaneous and stable continuation of the combustion of the combustible gas, the other fuels are combusted. While the combustible gas spontaneously and stably continues the combustion, the other fuels are not combusted. Therefore, the use amount of the other fuels is saved, and the running costs can be reduced.

Moreover, in the method of the present invention, in a period from the waste ignition until the temperature in the combustion furnace reaches the second preset temperature or more by the combustion of only the combustible gas, the combustion of the other fuels is intermittently performed by stopping the combustion of the other fuels when the temperature in the combustion furnace reaches the second preset temperature or more, and again igniting the waste when the temperature in the combustion furnace falls below the second preset temperature after the stop. When the temperature in the combustion furnace is not less than the second preset temperature even after the combustion of the other fuels, the intermittent combustion of the other fuels is finished.

In the method of the present invention, when the combustion of the other fuels is stopped, the temperature in the combustion furnace depends on the combustion of only the combustible gas. Therefore, a combustion state of the combustible gas can be detected by checking the temperature in the combustion furnace after stopping the combustion of the other fuels. Moreover, in the period, when the temperature in the combustion furnace reaches the second preset temperature or more, the combustion of the other fuels is stopped, and the temperature in the combustion furnace then falls below the second preset temperature, it is judged that the temperature in the combustion furnace does not possibly reach the first preset temperature or more by the combustion of only the combustible gas, and the other fuels are ignited again. Furthermore, when the temperature in the combustion furnace reaches the second preset temperature or more after the re-ignition, the combustion of the other fuels is stopped again, and the aforementioned operation is repeated.

Moreover, when the temperature in the combustion furnace is maintained at the second preset temperature or more even after the stop of the combustion of the other fuels, the temperature in the combustion furnace securely reaches the first preset temperature or more by the combustion of only the combustible gas, it is judged that the combustible gas can spontaneously and stably continue the combustion, and the combustion of the other fuels is finished.

Furthermore, in the method of the present invention, in a period from when the temperature in the combustion furnace falls below the third preset temperature until the temperature in the combustion furnace falls below the fourth preset temperature, the combustion of the other fuels is intermittently performed by stopping the combustion of the other fuels when the temperature in the combustion furnace reaches the third preset temperature or more, and again igniting the waste when the temperature in the combustion furnace falls below the third preset temperature after the stop. When the temperature in the combustion furnace falls below the third preset temperature even after the re-ignition, the combustion of the other fuels is continuously performed, and the temperature in the combustion furnace is maintained at the first preset temperature or more. Thereafter, when the temperature in the gasification furnace falls below the fourth preset temperature, the combustion of the other fuels is finished.

In the method of the present invention, when the temperature in the combustion furnace falls below the third preset temperature, the combustion of the other fuels is resumed. Moreover, when the temperature in the combustion furnace reaches the third preset temperature or more by the combustion of the other fuels, the combustion state of the combustible gas can be detected as described above by stopping the combustion of the other fuels and checking the temperature in the combustion furnace after the stop.

Therefore, in the period, when the temperature in the combustion furnace reaches the third preset temperature or more, the combustion of the other fuels is stopped, and the temperature in the combustion furnace falls below the third preset temperature, it is then judged that the temperature in the combustion furnace does not possibly reach the first preset temperature or more by the combustion of only the combustible gas, and the other fuels are ignited again. Moreover, when the temperature in the combustion furnace reaches the third preset temperature or more after the re-ignition, the combustion of the other fuels is stopped again, and the aforementioned operation is repeated.

Furthermore, when the temperature in the combustion furnace falls below the third preset temperature even after the re-ignition of the other fuels, it is judged that the temperature in the combustion furnace cannot be maintained at the first preset temperature or more by the combustion of only the combustible gas, the combustion of the other fuels is continuously performed, and the temperature in the combustion furnace is maintained at the first preset temperature or more. Thereafter, when the temperature in the gasification furnace falls below the fourth preset temperature, as described above, it is judged that the gas introduced into the combustion furnace from the gasification furnace contains no dioxins, and the combustion of the other fuels is finished.

In the method of the present invention, as described above, in the period from the waste ignition until the temperature in the combustion furnace reaches the second preset temperature or more by the combustion of only the combustible gas, or in the period from when the temperature in the combustion furnace falls below the third preset temperature until the temperature in the gasification furnace falls below the fourth preset temperature, the combustion of the other fuels is intermittently performed, so that amount of the other fuels can be saved, and the running costs can be reduced.

Moreover, in the method of the present invention, in a period from when the temperature in the combustion furnace falls below the third preset temperature until the temperature in the gasification furnace falls below the fourth preset temperature, the temperature in the gasification furnace is detected every predetermined time. After it is consecutively detected predetermined times that the temperature in the gasification furnace is less than the maximum temperature in the gasification furnace, and the temperature in the gasification furnace falls below the fourth preset temperature, the combustion of the other fuels is finished.

When the part of the waste able to be dry-distilled is reduced in the gasification furnace, the heat amount consumed in the dry distillation is not consumed, and the temperature in the gasification furnace rapidly starts rising by red heat of the waste. Moreover, when the red heating of the waste is finished and ashing starts, the temperature in the gasification furnace in turn drops from the maximum temperature at which the waste is red-heated.

However, since a material, capacity, and the like of the waste subjected to the incineration disposal by the method of the present invention are various, the red heating does not uniformly shift to the ashing. Even when the surface of the waste is ashed, a lower layer part is still red-heated, and the waste whose red heating is retarded sometimes remains. In this case, the temperature rises again by the red heating of the waste. This tendency becomes more remarkable when the gasification furnace has a large capacity.

Moreover, in the method of the present invention, as described above, the temperature in the gasification furnace is detected every predetermined time, it is consecutively detected predetermined times that the temperature in the gasification furnace is less than the maximum temperature in the gasification furnace, and it is then judged that the waste in the gasification furnace entirely shifts to an ashing stage. Thereafter, when the temperature in the gasification furnace falls below the fourth preset temperature, the combustion of the other fuels is finished. The dioxins emission caused by re-rising of the temperature in the gasification furnace can securely be prevented.

Furthermore, according to the method of the present invention, when the combustible gas generated by the dry distillation of the waste in the gasification furnace is introduced into the combustion furnace and combusted, a part of the combustible gas is dispensed and condensed, and oil content is collected and used as the other fuels.

In the method of the present invention, combustion assistant oils such as a heavy oil can be used as the other fuels. When only the combustion assistant oil is used, however, a burden added by a fuel becomes heavy. Then, the burden can be alleviated by dispensing a part of the combustible gas, and adding the condensed and collected oil content to the other fuels.

In a stage in which the dry distillation progresses well, a sufficient amount of combustible gas is generated to maintain the temperature in the combustion furnace to be substantially constant at the first preset temperature or more. Therefore, even when a part of the combustible gas is dispensed, the temperature in the combustion furnace is not influenced, and the substantially constant temperature is maintained. Moreover, when a combustible component contained in the combustible gas is condensed and liquefied, the component can easily be collected as the oil content.

Moreover, in the method of the present invention, when the other fuels are combusted, oxygen heated by the heat of the combustion furnace is supplied to the combustion furnace.

When heated oxygen is supplied to the combustion furnace, the heat amount consumed by heating oxygen in the combustion furnace is saved, and the combustion temperature of the combustible gas rises. Therefore, when the other fuels are combusted, the fuel can be reduced.

BEST MODE FOR CARRYING OUT THE INVENTION

An embodiment of the present invention will be described in more detail with reference to the accompanying drawings.

Figure 1:
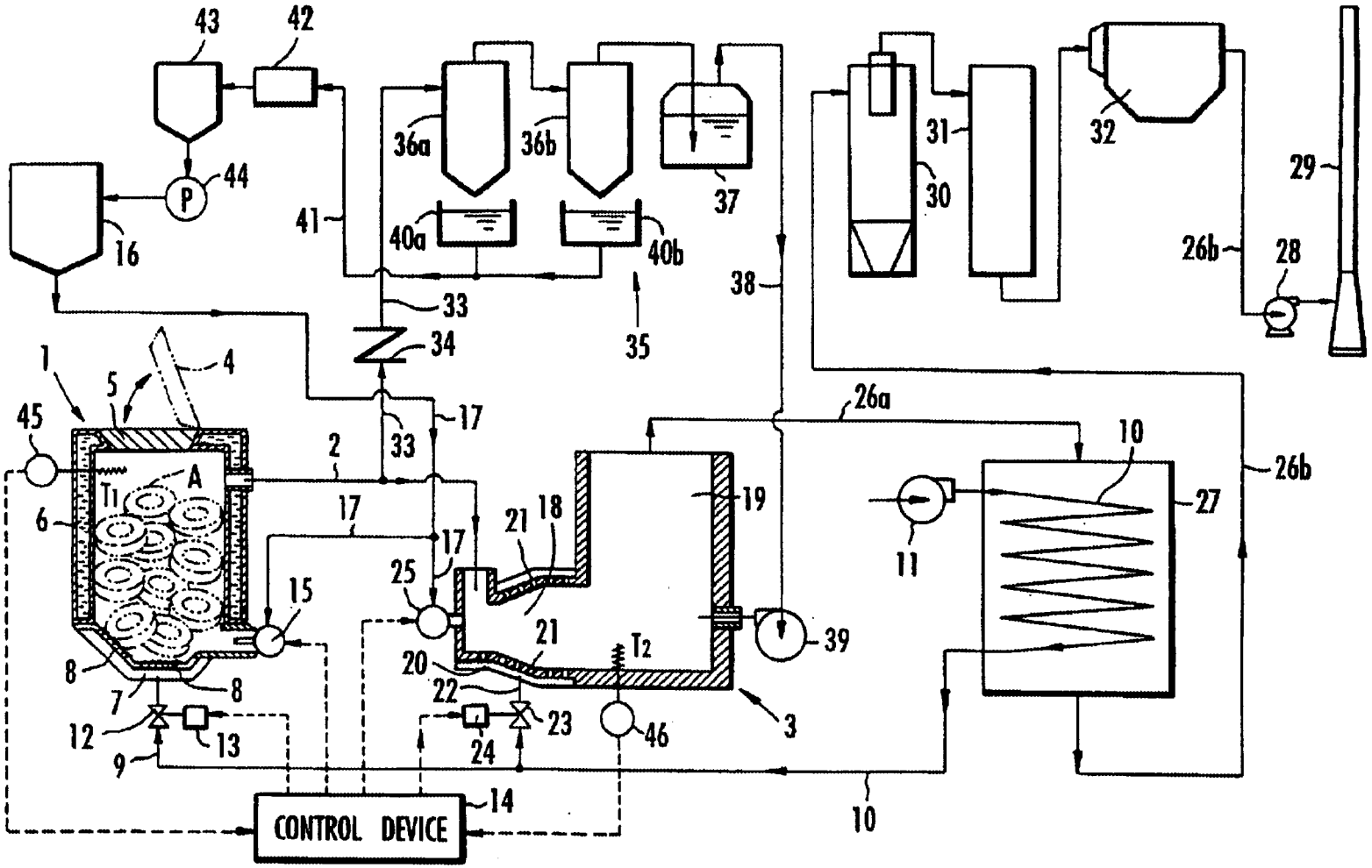
FIG. 1 is a system constitution diagram showing one embodiment of an apparatus for dry distillation, gasification and incineration disposal of a waste for use in an incineration disposal method of the present invention.

As shown in FIG. 1, an apparatus for dry distillation, gasification and incineration disposal of a waste according to the present embodiment is provided with a gasification furnace 1 for containing a waste A which is a mixture of various wastes mainly of waste tires; and a combustion furnace 3 connected to the gasification furnace 1 via a gas passage 2. An introduction port 5 provided with an openable/closable introduction door 4 is formed in an upper surface of the gasification furnace 1, and a waste A such as a waste tire can be introduced into the gasification furnace 1 via the introduction port 5. Moreover, while the introduction door 4 is closed, the gasification furnace 1 is substantially shut off from the outside.

A water jacket 6 isolated from the interior of the gasification furnace 1 is formed as a cooling structure on an outer periphery of the gasification furnace 1. Water is supplied to the water jacket 6 from a water supply device (not shown), and an interior water amount is maintained at a predetermined water level.

A lower part of the gasification furnace 1 is formed in a frustoconical shape which projects downward. An empty chamber 7 isolated from the interior of the gasification furnace 1 is formed in the outer periphery of the lower part of the frustoconical shape. The empty chamber 7 is connected to the interior of the gasification furnace 1 via a plurality of air supply nozzles 8 disposed in an inner wall of the gasification furnace 1.

The empty chamber 7 of the lower part of the gasification furnace 1 is connected to a dry distillation oxygen supply path 9. The dry distillation oxygen supply path 9 is connected to an oxygen (air) supply source 11 constituted of a blower fan via a main oxygen supply path 10. The dry distillation oxygen supply path 9 is provided with a control valve 12, and an open degree of the control valve 12 is controlled by a valve drive unit 13. In this case, the valve drive unit 13 is controlled by a control device 14 constituted of an electronic circuit including CPU, and the like.

Furthermore, an igniter 15, controlled by the control device 14, for igniting the waste A contained in the gasification furnace 1 is attached to the lower part of the gasification furnace 1. The igniter 15 is constituted of an ignition burner or the like, and supplies combustion flame to the waste A by combusting a fuel supplied from a fuel supply device 16 in which combustion assistant oils such as a heavy oil are stored via a fuel supply path 17.

The combustion furnace 3 is constituted of a burner section 18 for mixing a combustible gas generated by dry distillation of the waste A with oxygen (air) necessary for complete combustion of the gas, and a combustion section 19 for combusting the combustible gas mixed with oxygen. The combustion section 19 is connected to the burner section 18 on the tip end side of the burner section 18. The gas passage 2 is connected to the rear end of the burner section 18, and the combustible gas generated by the dry distillation of the waste A in the gasification furnace 1 is introduced into the burner section 18 via the gas passage 2.

An empty chamber 20 isolated from the interior of the burner section is formed in the outer periphery of the burner section 18, and the empty chamber 20 is connected to the interior of the burner section 18 via a plurality of nozzle holes 21 formed in the inner periphery of the burner section 18. The empty chamber 20 is connected to a combustion oxygen supply path 22 branched from the main oxygen supply path 10. The combustion oxygen supply path 22 is provided with a control valve 23, and the open degree of the control valve 23 is controlled by a valve drive unit 24. In this case, the valve drive unit 24 is controlled by the control device 14.

A combustion device 25, controlled by the control device 14, for combusting the combustion assistant oils such as the heavy oil supplied from the fuel supply device 16 via the fuel supply path 17 is attached to the rear end of the burner section 18. The combustion device 25 is constituted of an ignition burner or the like, and combusts the combustion assistant oil. Additionally, the combustion device 25 is also used in igniting the combustible gas introduced into the burner section 18.

A duct 26*a* for discharging waste gas after complete combustion of the combustible gas by the combustion section 19 is disposed on the tip end of the combustion section 19, and is connected to one end of a heat exchanger 27. The main oxygen supply path 10 is disposed in the heat exchanger 27. When heat is exchanged between the waste gas and oxygen flowing through the main oxygen supply path 10, oxygen is heated.

The other end of the heat exchanger 27 is connected to a duct 26*b* for discharging the waste gas having exchanged heat with oxygen to the atmosphere via a blower fan 28 and funnel 29, and a cyclone 30, cooling tower 31, and bug filter 32 are disposed midway along the duct 26*b*.

Furthermore, for the apparatus of the present embodiment, a dispenser guide pipe 33 for dispensing a part of the combustible gas introduced into the combustion furnace 3 from the gasification furnace 1 is connected midway to the gas passage 2 via a check valve 34, and the dispensed combustible gas is guided into an oil content collector 35. The oil content collector 35 is constituted of capacitors 36*a*, 36*b* for condensing the dispensed combustible gas, and an oil separator 37 for further collecting a combustible component which is not condensed by the capacitors 36*a*, 36*b*. The oil separator 37 is connected to the combustion furnace 3 via a gas guide pipe 38, and the gas containing the combustible component which cannot be separated even by the oil separator 37 is introduced into the combustion section 19 of the combustion furnace 3 via the gas guide pipe 38 and blower fan 39.

Storage tanks 40*a*, 40*b* for storing the condensed oil content are disposed below the capacitors 36*a*, 36*b*. The oil content condensed by the capacitors 36*a*, 36*b* is guided via a collected oil guide pipe 41 from the storage tanks 40*a*, 40*b*, passed through an oil/water separator 42 and filter 43, and fed to the fuel supply device 16 via a pump 44.

Additionally, in the apparatus of the present embodiment, a temperature sensor 45 for detecting a temperature $T_1$ in the gasification furnace 1 is attached to the upper part of the gasification furnace 1, and a temperature sensor 46 for detecting a temperature $T_2$ in the combustion furnace 3 is attached to the combustion furnace 3 in a position opposite to the tip end of the burner section 18. Detection signals of the temperature sensors 45, 46 are inputted to the control device 14.

Figure 2:
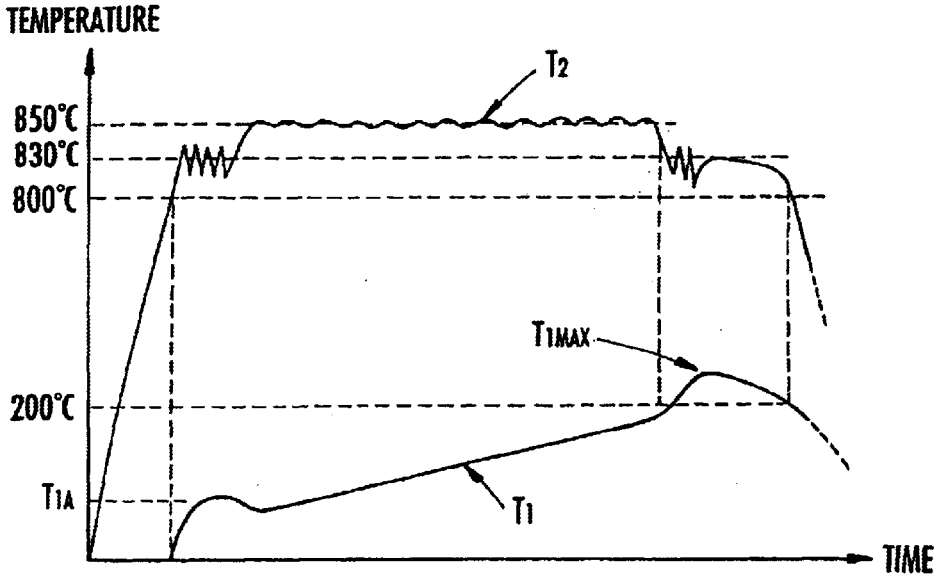
FIG. 2 is a graph showing changes of a temperature in a gasification furnace and a combustion temperature in a combustion furnace with elapse of time in the incineration disposal method of the present invention. Moreover.
Figure 3:
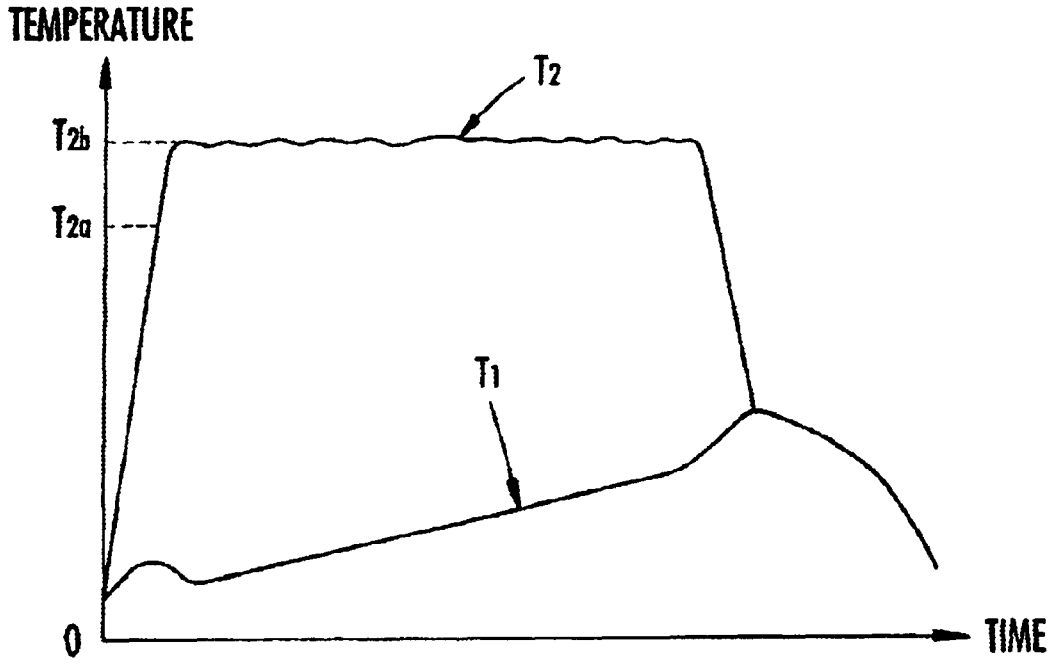
FIG. 3 is a graph showing the changes of the temperature in the gasification furnace and the combustion temperature in the combustion furnace with elapse of time in a conventional incineration disposal method.

A waste incineration disposal method by the apparatus of the present embodiment will next be described with reference to FIGS. 1 and 2.

In the apparatus shown in FIG. 1, when the waste A is incinerated and disposed of, first the introduction door 4 of the gasification furnace 1 is opened, and the waste A is introduced into the gasification furnace 1 via the injection port 5. The waste A is a mixture of various wastes mainly of the waste tire, and regulated to have heat amount such that combustion temperature is 800° C. (first preset temperature) or more during continuation of combustion of the stable combustible gas generated by the dry distillation in the gasification furnace 1. In the present embodiment, the waste is further regulated to have the heat amount with the combustion temperature of 850° C. or more.

Subsequently, the introduction door 4 is closed to bring the interior of the gasification furnace 1 to a fully closed state, the combustion device 25 of the combustion furnace 3 is operated by the control device 14 prior to ignition of the waste A, and thereby the combustion of the combustion assistant oil is started. The temperature $T_2$ in the combustion furnace 3 gradually rises by the combustion of the combustion assistant oil. When the temperature $T_2$ detected by the temperature sensor 46 exceeds 800°C., the igniter 15 of the gasification furnace 1 is operated by the control device 14, the waste A is ignited, and partial combustion of the waste A starts. When the partial combustion of the waste A starts, the temperature $T_1$ in the gasification furnace 1 gradually rises, the temperature $T_1$ detected by the temperature sensor 45 reaches a preset temperature $T_{1A}$, the control device then judges that the ignition is performed without any abnormality and the igniter 15 is stopped.

During the ignition, the control valve 12 of the dry distillation oxygen supply path 9 is opened beforehand with a relatively small predetermined open degree via the valve drive unit 13 controlled by the control device 14. As a result, the waste A is ignited by the igniter 15 using oxygen present in the gasification furnace 1, and a small amount of oxygen supplied to the gasification furnace 1 from the oxygen (air) supply source 11 via the main oxygen supply path 10 and dry distillation oxygen supply path 9.

When the partial combustion of the waste A starts in the lower layer part of the waste A in the gasification furnace 1 by the ignition, the dry distillation of the upper layer part of the waste A starts by the combustion, and the combustible gas generated by the dry distillation is introduced into the burner section 18 of the combustion furnace 3 via the gas passage 2 connected to the gasification furnace 1. After the ignition, according to a predetermined program, the control device 14 gradually increases the open degree of the control valve 12 disposed in the dry distillation oxygen supply path 9 in a stepwise manner. As a result, a sufficient amount of oxygen necessary for the continuous combustion is supplied to the lower layer part of the waste A, the combustion of the lower layer part of the waste A is stabilized without being excessively enlarged, and the dry distillation of the upper layer part of the waste A is stably be performed.

When the combustible gas is introduced into the burner section 18 of the combustion furnace 3, the control valve 23 of the combustion oxygen supply path 22 is opened beforehand with the predetermined open degree by the valve drive unit 24 controlled by the control device 14. Then, the combustible gas introduced into the burner section 18 is mixed with oxygen supplied via the combustion oxygen supply path 22 in the burner section 18, is ignited by combustion flame supplied via the combustion device 25, and starts to be combusted with the combustion assistant oil in the combustion section 19.

At the start of the combustion of the combustible gas, the generation of the combustible gas by the dry distillation is unstable, and the combustible gas is not stably supplied to the combustion furnace 3 in some cases. However, as the dry distillation in the gasification furnace 1 becomes stable as described above, the combustible gas is continuously generated, and generated amount also increases.

In this case, when the amount of generated combustible gas increases and the temperature $T_2$ in the combustion furnace 3 rises, the combustible gas can spontaneously and stably continue the combustion by its own combustion heat. Therefore, when the temperature $T_2$ in the combustion furnace 3 detected by the temperature sensor 46 reaches a second preset temperature above 800° C., for example, 830° C. or more, the control device 14 stops the combustion of the combustion assistant oil by the combustion device 25. It is judged according to a change of the temperature $T_2$ after the stop whether the combustible gas can spontaneously and stably continue the combustion.

That is to say, when the temperature $T_2$ in the combustion furnace 3 falls below 830° C. after the stop of the combustion of the combustion assistant oil it is judged that the combustible gas is not ready to be spontaneously combusted, the combustion device 25 is re-ignited, and the combustion of the combustion assistant oil is resumed. Moreover, when the temperature $T_2$ in the combustion furnace 3 reaches 830° C. or more, the combustion of the combustion assistant oil by the combustion device 25 is stopped again, and an operation of judging whether the combustible gas can spontaneously and stably continue the combustion is repeated.

As a result, the combustion of the combustion assistant oil by the combustion device 25 is stopped when the temperature $T_2$ in the combustion furnace 3 reaches 830° C. or more, and resumed when the temperature falls below 830° C. The combustion is intermittently performed in this manner, and the temperature $T_2$ in the combustion furnace 3 changes in a zigzag manner as shown in FIG. 2. Moreover, even after stopping the combustion of the combustion assistant oil by the combustion device 25, the temperature $T_2$ in the combustion furnace 3 is maintained at 830° C. or more, the control device 14 then judges that the combustible gas is ready for spontaneous combustion by its own combustion heat, and the combustion of the combustion assistant oil by the combustion device 25 is finished. Thereafter, the spontaneous combustion of only the combustible gas is performed, and the temperature $T_2$ in the combustion furnace 3 detected by the temperature sensor 46 substantially indicates the combustion temperature of the combustible gas itself.

When the spontaneous combustion of only the combustible gas is performed, the combustion temperature of the combustible gas itself detected as the temperature $T_2$ in the combustion furnace 3 is maintained to be substantially constant at 830° C. or more, for example, at 850° C. In this case, the control device 14 automatically controls the open degree of the control valve 23 of the combustion oxygen supply path 22 so that the sufficient amount of oxygen necessary for the complete combustion of the combustible gas is supplied to the burner section 18. Concretely, the control is performed so as to reduce the open degree of the control valve 23 and decrease the oxygen supply amount to the burner section 18, when the combustion temperature $T_2$ of the combustible gas in the combustion furnace 3 falls below 850° C. Conversely, when the temperature $T_2$ is higher than 850° C., the open degree of the control valve 23 is enlarged and the oxygen supply amount to the burner section 18 is increased.

Moreover, the control device 14 automatically controls the open degree of the control valve 12 in accordance with the combustion temperature $T_2$ of the combustible gas in the combustion furnace 3, detected by the temperature sensor 46, and thereby adjusts the amount of the generated combustible gas in the gasification furnace 1, so that the combustion temperature $T_2$ of the combustible gas in the combustion furnace 3 is maintained to be substantially constant at 850° C. Concretely, the control is performed so as to increase the open degree of the control valve 12, increase the oxygen supply amount to the gasification furnace 1, and promote the generation of the combustible gas by the dry distillation, when the combustion temperature $T_2$ of the combustible gas in the combustion furnace 3 is lower than 850° C. Conversely, the control is performed so as to reduce the open degree of the control valve 12, decrease the oxygen supply amount to the gasification furnace 1, and inhibit the generation of the combustible gas by the dry distillation, when the combustion temperature $T_2$ of the combustible gas in the combustion furnace 3 is higher than 850° C. Thereby, in the gasification furnace 1 the combustion of the lower layer part and the dry distillation of the upper layer part of the waste A stably progress, and the temperature $T_2$ in the combustion furnace 3 is maintained to be substantially constant at 850° C. as shown in FIG. 2.

Furthermore, the temperature $T_1$ in the gasification furnace 1 detected by the temperature sensor 45 rises with the combustion of the lower layer part of the waste A immediately after the waste A is ignited during operation of the combustion device 25, and thereafter drops once because the combustion heat of the lower layer part of the waste A is consumed by the dry distillation of the upper layer part. Subsequently, the combustion device 25 is stopped, and the spontaneous combustion of only the combustible gas is performed. Then, in a stage in which the dry distillation stably progresses in a stationary manner (the temperature $T_2$ in the combustion furnace 3 is maintained to be substantially constant at 850° C.), the temperature $T_1$ in the gasification furnace 1 gradually rises with the progress of the dry distillation.

In the stage in which only the combustible gas is spontaneously combusted, the generation of the combustible gas progresses. Even when a part of the combustible gas is dispensed, a sufficient amount of combustible gas can be obtained to maintain the temperature $T_2$ in the combustion furnace 3 to be substantially constant at 850° C. Therefore, in this stage, as described above, a part of the combustible gas is dispensed by the dispenser guide pipe 33, and the combustible component contained in the combustible gas is collected as an oil content by the oil content collector 35.

Subsequently, the dry distillation progresses, and the portion of the waste A able to be dry-distilled becomes short.

In this case, even when the open degree of the control valve 12 of the dry distillation oxygen supply path 9 is adjusted to increase the oxygen supply amount to the gasification furnace 1, a sufficient amount of combustible gas for maintaining the temperature $T_2$ in the combustion furnace 3 to be substantially constant at 850° C. cannot be generated. In this state, the temperature $T_2$ in the combustion furnace 3 tends to drop from 850° C.

Then, the control device 14 resumes the combustion of the combustion assistant oil by the combustion device 25, when the temperature $T_2$ in the combustion furnace 3 reaches a third preset temperature in a range of 800° C. to 850° C., for example, 830° C. In this stage, when the temperature $T_2$ in the combustion furnace 3 reaches 830° C. or more, the control device 14 stops the combustion of the combustion assistant oil by the combustion device 25, and judges, according to the change of the temperature $T_2$ in the combustion furnace 3 after the stop, whether the combustible gas can spontaneously and stably continue the combustion.

That is to say, when the temperature $T_2$ in the combustion furnace 3 falls below 830° C. after the stop of the combustion of the combustion assistant oil, the control device 14 Judges that the combustible gas cannot spontaneously be combusted by the own combustion heat, actuates the combustion device 25 again, and resumes the combustion of the combustion assistant oil. Moreover, when the temperature $T_2$ in the combustion furnace 3 reaches 830° C. or more, the control device repeats the operation of stopping again the combustion of the combustion assistant oil by the combustion device 25 and judging whether the combustible gas can spontaneously and stably continue the combustion.

As a result, the combustion of the combustion assistant oil by the combustion device 25 is stopped when the temperature $T_2$ in the combustion furnace 3 is 830° C. or more, resumed when the temperature falls below 830° C., and intermittently performed in this manner. In this case, the temperature $T_2$ in the combustion furnace 3 changes in a zigzag manner as shown in FIG. 2. Subsequently, when the temperature $T_2$ in the combustion furnace 3 cannot be raised to 830° C. or more even by the combustion of the combustion assistant oil by the combustion device 25, the control device 14 judges that the combustible gas cannot spontaneously be combusted, continuously combusts the combustion assistant oil by the combustion device 25 and maintains the temperature $T_2$ in the combustion furnace 3 at 800° C. or more.

On the other hand, when the portion of the waste A able to be dry-distilled becomes poor, the waste A is brought to an entire combustion state, and the temperature $T_1$ in the gasification furnace 1 rapidly rises. Subsequently, the temperature in turn decreases from a maximum temperature $T_{MAX}$ at which the portion of the waste A able to be dry-distilled is eliminated and the red heated waste A starts to be ashed. However, since the capacity, material, and the like of the waste A are various, a part of the waste is red-heated or not red-heated under the ashed surface layer, and the temperature $T_1$ in the gasification furnace 1 sometimes rises again because of the heat of this part.

Therefore, when the temperature $T_2$ in the combustion furnace 3 falls below 830° C., the control device 14 compares the temperature $T_1$ in the gasification furnace 1 detected by the temperature sensor 45 with the maximum temperature $T_{MAX}$ in the gasification furnace 1 every predetermined time, for example, every ten minutes. Subsequently, when the temperature $T_1$ in the gasification furnace 1 consecutively indicates the temperature being less than the maximum temperature $T_{MAX}$ predetermined times, for example, three times, it is judged that the waste A in the gasification furnace 1 securely and entirely shifts to the ashing stage.

Thereafter, the temperature $T_1$ in the gasification furnace 1 indicates a fourth preset temperature, for example, falls below 200° C. which is less than a dioxins generation temperature. Then, it is judged that the combustible gas does not contain dioxins and that it is unnecessary to maintain the temperature $T_2$ in the combustion furnace 3 at 800° C. or more, and the combustion of the combustion assistant oil by the combustion device 25 is finished.

Subsequently, the ashing of the waste A progresses In the gasification furnace 1. Moreover, with the degrease of the portion of the waste A able to be dry-distilled, the amount of the combustible gas decreases in the combustion furnace 3, and the spontaneous combustion cannot be maintained. As a result, the temperature Tin then gasification furnace 1 and the temperature $T_2$ in the combustion furnace 3 gradually drop, thereby resulting in natural extinction.

A method of collecting the oil content from a part of the combustible gas by the oil content collector 35 will next be described.

In the present embodiment, in the stage of the stable combustion of the combustible gas in the combustion furnace 3 (in the stage in which the temperature $T_2$ in the combustion furnace 3 is maintained to be substantially constant at 850° C.), much combustible gas is generated in the gasification furnace 1. Therefore, when a pressure of the combustible gas in the gas passage 2 exceeds a predetermined magnitude in the stage of stable dry distillation, a part of the combustible gas passes the check valve 34 of the dispenser guide pipe 33 and is introduced into the oil content collector 35. For the combustible gas introduced into the oil content collector 35, the combustible component which is easily liquefied is first condensed in the capacitors 36*a*, 36*b* arranged in series, and the liquefied oil content is contained in the storage tanks 40*a*, 40*b*. The oil content is extracted by the pump 44, refined by the oil/water separator 42 and filter 43, subsequently fed to the fuel supply device 16, and used as a part of the combustion assistant oil in the next operation of the combustion device 25.

Subsequently, the combustible gas is fed to the oil separator 37, and the combustible component which as not been condensed in the capacitors 36*a*, 36*b* is collected as the oil content. Moreover, the remaining combustible gas containing the combustible component which has not been collected even by the oil separator 37 is introduced into the combustion section 19 of the combustion furnace 3 from the gas guide pipe 38 via the blower fan 39 and combusted.

Discharge of waste gas of the combustion furnace 3 will next be described.

In the present embodiment, waste gas of the combustion furnace 3 is first fed to the heat exchanger via the duct 26*a*, and used in heating oxygen flowing through the main oxygen supply path 10 disposed in the heat exchanger 27. Since the heated oxygen is introduced into the combustion furnace 3 via the combustion oxygen supply path 22 to raise the temperature $T_2$ in the combustion furnace 3, the fuel supplied from the fuel supply device 16 can be saved during the operation of the combustion device 25. Moreover, in the stage of the stable dry distillation, the amount of the combustible gas necessary for maintaining the temperature $T_2$ in the combustion furnace 3 to be substantially constant at a preset temperature $T_{2A}$ is reduced, and the amount of the combustible gas able to be dispensed via the dispenser guide pipe 33 can be increased.

Furthermore, when heated oxygen is introduced into the gasification furnace 1 via the dry distillation oxygen supply path 9, an effect that the combustion of the waste A is further stabilized can also be obtained.

The waste gas used in heating oxygen in the heat exchanger 27 is introduced into the cyclone 30 via the duct 26*b*, and dust contained in the waste gas is removed. Subsequently, the waste gas is introduced into the cooling tower 31 and sufficiently cooled, and is then introduced into the bug filter 32. Subsequently, after fine flied ash is removed from the waste gas by the bug filter 32, the waste gas is finally discharged to the atmosphere via the blower fan 28 and funnel 29.

What is claimed is:

1. A waste incineration disposal method comprising steps of: combusting a part of a waste contained in a gasification furnace, and dry-distilling the other part of the waste by a combustion heat; and introducing a combustible gas generated by the dry distillation into a combustion furnace to combusted the combustible gas, wherein when the combustible gas is combusted in the combustion furnace, oxygen required for the combustion is supplied to the combustion furnace in accordance with an amount of the combustible gas introduced into the combustion furnace to combusted the combustible gas, an amount of oxygen supplied to the gasification furnace is controlled in accordance with a temperature change in the combustion furnace caused by the combustion of the combustible gas in the combustion furnace, the amount of the combustible gas generated by the dry distillation is adjusted, and the temperature in the combustion furnace is maintained at a first preset temperature or more, said waste incineration disposal method further comprising steps of:

containing in the gasification furnace the waste regulated to generate the combustible gas having a heat amount for setting the temperature in the combustion furnace at the first preset temperature or more, combusting fuels other than the combustible gas in the combustion furnace prior to ignition of the waste, igniting the waste to start dry distillation and combusting the generated combustible gas with the other fuels when the temperature in the combustion furnace reaches the first preset temperature or more, and finishing the combustion of the other fuels when the temperature in the combustion furnace reaches a second preset temperature higher than the first preset temperature or more by the combustion of only the combustible gas;

maintaining the temperature in the combustion furnace to be substantially constant at the second preset temperature or more by combusting only the combustible gas;

resuming the combustion of the other fuels and combusting the combustible gas with the other fuels when the temperature in said combustion furnace falls below a third preset temperature lower than the substantially constant temperature and higher than the first preset temperature, maintaining the temperature in the combustion furnace at the first preset temperature or more, and finishing the combustion of the other fuels when the temperature in the gasification furnace falls below a fourth preset temperature, wherein said fourth preset temperature is lower than a maximum temperature in the gasification furnace.

2. The waste incineration disposal method according to claim 1 wherein the first preset temperature is a temperature at which dioxins can thermally be decomposed.

3. The waste incineration disposal method according to claim 1 or 2 wherein the first preset temperature is 800° C. or more.

4. The waste incineration disposal method according to any one of claims 1 or 2 wherein the fourth preset temperature is less than a dioxins generation temperature.

5. The waste incineration disposal method according to any one of claims 1 or 2 wherein in a period from the ignition of said waste until the temperature in said combustion furnace reaches the second preset temperature or more by the combustion of only said combustible gash said combustion of the other fuels is intermittently performed by stopping the combustion of the other fuels when the temperature in the combustion furnace reaches the second preset temperature or more, and re-igniting the waste when the temperature in the combustion furnace falls below the second preset temperature after the stop, and the intermittent combustion of the other fuels is finished when the temperature in the combustion furnace is not less than the second preset temperature even after the stop of the combustion of the other fuels.

6. The waste incineration disposal method according to any one of claims 1 or 2 wherein in a period from when the temperature in said combustion furnace falls below the third preset temperature until the temperature in said gasification furnace falls below the fourth preset temperature, said combustion of the other fuels is intermittently performed by stopping the combustion of the other fuels when the temperature in the combustion furnace reaches the third preset temperature or more, and re-igniting the waste when the temperature in the combustion furnace falls below the third preset temperature after the stop, the combustion of the other fuels is continuously performed to maintain the temperature in the combustion furnace at the first preset temperature or more when the temperature in the combustion furnace falls below the third preset temperature even after the re-ignition, and the combustion of the other fuels is finished when the temperature in said gasification furnace falls below the fourth preset temperature.

7. The waste incineration disposal method according to claim 6 wherein when the temperature in said gasification furnace is detected every predetermined time, it is consecutively detected predetermined times that the temperature in the gasification furnace is less than the maximum temperature in the gasification furnace, and the temperature in the gasification furnace falls below the fourth preset temperature, said combustion of the other fuels is finished.

8. The waste incineration disposal method according to claim 1 wherein when said combustible gas generated by the dry distillation of the waste in said gasification furnace is introduced into said combustion furnace and combusted, a part of the combustible gas is dispensed and condensed, and an oil content is collected from the part of the combustible gas and used as said other fuels.

9. The waste incineration disposal method according to claim 1 wherein when said other fuels are combusted, oxygen heated by the heat of said combustion furnace is supplied to said combustion furnace.

* * * * *